US012540002B2

(12) United States Patent
Perrault

(10) Patent No.: US 12,540,002 B2
(45) Date of Patent: Feb. 3, 2026

(54) PLEATED PORTION CUP AND LID

(71) Applicant: GENPAK, DIVISION OF GREAT PACIFIC ENTERPRISES LP, Mississauga (CA)

(72) Inventor: Jean-Guy Perrault, Mississauga (CA)

(73) Assignee: GENPAK, DIVISION OF GREAT PACIFIC ENTERPRISES LP, Mississauga (CA)

( * ) Notice: Subject to any disclaimer, the term of this patent is extended or adjusted under 35 U.S.C. 154(b) by 0 days.

(21) Appl. No.: 18/555,119

(22) PCT Filed: May 3, 2022

(86) PCT No.: PCT/CA2022/050687
§ 371 (c)(1),
(2) Date: Oct. 12, 2023

(87) PCT Pub. No.: WO2022/246538
PCT Pub. Date: Dec. 1, 2022

(65) Prior Publication Data

US 2024/0208689 A1 Jun. 27, 2024

Related U.S. Application Data

(60) Provisional application No. 63/192,599, filed on May 25, 2021.

(51) Int. Cl.

| | |
|---|---|
| ***B65D 1/46*** | (2006.01) |
| ***B65D 43/02*** | (2006.01) |
| *B65D 23/08* | (2006.01) |
| *B65D 43/06* | (2006.01) |

(52) U.S. Cl.
CPC ..... *B65D 1/46* (2013.01); *B65D 43/0264* (2013.01); *B65D 23/0814* (2013.01); *B65D 43/06* (2013.01); *B65D 2543/00268* (2013.01)

(58) Field of Classification Search
CPC ... B65D 3/06; B65D 3/12; B65D 1/46; B65D 1/44; B65D 1/42; B65D 23/0814; B65D 43/0212; B65D 43/0222; B65D 43/0264; B65D 43/0235; B65D 43/06; B65D 13/04; B65D 2543/00268
USPC ..... 220/657, 656, 673, 671, 670, 669, 220/DIG. 30, DIG. 11; 229/404, 400
See application file for complete search history.

(56) References Cited

U.S. PATENT DOCUMENTS

| | | | |
|---|---|---|---|
| 1,065,486 | A | 6/1913 | Washburn |
| 1,497,755 | A | 6/1924 | Huntley |
| 1,743,215 | A | 1/1930 | Hill |
| 1,766,226 | A | 6/1930 | Nias et al. |

(Continued)

FOREIGN PATENT DOCUMENTS

| | | | |
|---|---|---|---|
| EP | 785137 A1 * | 7/1997 | ..... B65D 1/28 |
| GB | 611325 | 7/1947 | |

(Continued)

*Primary Examiner* — Robert J Hicks
(74) *Attorney, Agent, or Firm* — MORGAN, LEWIS & BOCKIUS LLP

(57) ABSTRACT

A pleated paper container for holding a food product or non-food product, comprising a base, side walls, a rim, and a stopper step disposed at the side walls proximate to the rim, wherein the stopper step is configured to receive and frictionally engage a fibre lid in a covered position, thereby closing an opening of the container and enclosing the product.

11 Claims, 5 Drawing Sheets

(56) References Cited

U.S. PATENT DOCUMENTS

| | | | | |
|---|---|---|---|---|
| 3,095,132 | A | 6/1963 | Hawley | |
| 3,809,310 | A | 5/1974 | VanderLugt, Jr. | |
| 4,886,206 | A * | 12/1989 | Martinez | B65D 1/265 229/123.1 |
| 5,506,046 | A | 4/1996 | Anderson et al. | |
| 5,531,375 | A | 7/1996 | Palm | |
| 6,612,485 | B2 | 9/2003 | Lackner et al. | |
| 6,926,197 | B2 | 8/2005 | Hed et al. | |
| 8,584,884 | B2 * | 11/2013 | Learn | B65D 5/5286 229/404 |
| 9,737,161 | B1 | 8/2017 | Li | |
| 2005/0258225 | A1 | 11/2005 | Martin | |
| 2007/0164045 | A1 | 7/2007 | Wydler et al. | |
| 2010/0176130 | A1 | 7/2010 | Kim | |
| 2010/0276476 | A1 * | 11/2010 | West | B65D 65/466 229/125.17 |

FOREIGN PATENT DOCUMENTS

| | | | |
|---|---|---|---|
| GB | 703834 | A | 2/1954 |
| GB | 788718 | | 1/1958 |

* cited by examiner

PLEATED PORTION CUP AND LID

CROSS-REFERENCE TO RELATED APPLICATIONS

The application is a National Stage of International Patent Application No. PCT/CA2022/050687 filed May 3, 2022, and published as WO 2022/246538 A1, which claims priority to Provisional Patent Application No. 63/192,599 filed May 25, 2021, the entire contents of which applications is incorporated herein for all purposes by this reference

FIELD OF THE INVENTION

The present invention relates to the field of pleated paper cups, typically for use in the fast-food industries for containing food/condiments. More specifically, the present invention relates to disposable pleated paper portion cups.

BACKGROUND/DESCRIPTION OF THE RELATED ART

Pleated paper portion cups (sometimes referred to herein as "pleated portion cups" or "portion cups" for convenience, and also sometimes referred to in the industry as "souffle cups") are widely used in a number of industries, such as in fast-food restaurants (where they are most commonly used to contain/transport condiments and/or other small portions or food) and in laboratory and medical facilities (typically to contain portioned medication/pills/tablets).

Such pleated paper cups are generally manufactured from paper and usually meant to be single use, after which they are disposed. As such, these pleated paper cups are generally of simple construction, compact and low cost. Generally, these are also required to be compostable or recyclable.

In the case of pleated paper portion cups that are used for containing/transporting a small portion of condiments, the fact that the condiment is not covered, gives rise to several potential issues. For example, there are hygiene issues in that the condiment may be (or perceived by restaurant customers to be) more easily contaminated (e.g. by dust, germs, smoke, or other airborne contaminants, moisture, saliva, etc.) or cross contaminated by/with other foods. Further, the condiment may be more susceptible to spillage when the pleated paper portion cup(s) is being transported. As such, it is contemplated that it could be desirable to be able to provide for lidded condiment containers, which will nevertheless have many of the advantages of existing pleated paper portion cups (such as low-cost, simple design, ease of use, recyclable and compostable, etc.).

In terms of prior art, it appears that various attempts to integrate a container of relatively simple construction with a lid have been put forward.

U.S. Pat. No. 5,531,375 discloses a packaging container for beverages and a blank for producing the same, and shows a full blank with the folding step to manufacture the container and lid at the same time.

U.S. Pat. No. 1,743,215 discloses a separate lid and a paper cup, where the basic principle involves providing a groove inside a cup in order to receive a lid, and to keep the lid secured.

U.S. Pat. No. 3,095,132 shows a combination lid and stand for paper cups, in which a new device is adapted to serve as either a lid or a stand for paper cup.

U.S. Pat. No. 9,737,161 discloses a paper cup, a blank for a paper cup, and use of a paper cup, in which the improvement relates to using a full blank, that is folded to create the cup and lid with the same piece of paper.

However, such prior art is not directly applicable to the present situation, and each of these have shortcomings and/or do not have all the advantages that may be provided by the invention disclosed herein.

BRIEF SUMMARY OF THE INVENTION

In accordance with an aspect of the present invention, disclosed herein is an improved pleated paper portion cup.

In accordance with an aspect of the present invention, disclosed herein is a disposable container for holding a food product, comprising: (i) a substantially circular-shaped base; (ii) substantially annular side walls, the side walls having a lower ring and an upper ring, the lower ring connected to and extending around a periphery of the base, and the upper ring forming a substantially circular-shaped rim and defining an opening, and the side walls having a plurality of pleated folds extending from the base to the rim to strengthen the side walls; and (iii) an annular stopper step, disposed around a periphery of the side walls proximate the rim, wherein the stopper step is configured to receive and frictionally engage a substantially circularly-shaped fibre lid in a covered position thereby closing the opening, and wherein, when the fibre lid is placed in the covered position, the base, the side walls and the fibre lid together define an enclosed inside space for containing the food product.

In some aspects, the container is made from paper. In yet other aspects, the base, the rim, the stopper step and the side walls of the container are unitary and formed from a single paper blank.

In accordance with another aspect of the present invention, disclosed herein is the above described container additionally comprising a fibre lid, wherein the fibre lid is sized to frictionally engage with the stopper step at a covered position, thereby closing the opening and covering the food product. In some aspects, the fibre lid may be made of card or carboard. In yet other aspects, the fibre lid is provided with a tear tab to facilitate subsequent removal of the fibre lid.

In certain aspects, the container and the fibre lid are made from compostable materials. In some aspects, the paper and/or the fibre lid are provided with a coating of wax, bio-resin or a non-plastic biodegradable material, to improve the container's resistance to oils, grease and/or moisture.

In some aspects of the present invention, the side walls of the container extend upwardly and outwardly from the base, such that the diameter of the upper ring is greater than the diameter of the lower ring.

In some aspects, the food product is a condiment.

In accordance with another aspect of the present invention, disclosed herein is a method of making the pleated portion cup.

In accordance with another aspect of the present invention, disclosed herein is an apparatus for making the pleated portion cup.

BRIEF DESCRIPTION OF THE DRAWINGS

Embodiments of the present invention are described below with reference to the accompanying drawings in which.

DETAILED DESCRIPTION OF THE INVENTION

In accordance with a preferred embodiment of the present invention, disclosed herein is a pleated portion cup which is provided with a stopper step. The stopper step is configured to receive and engage with a lid of simple construction. The lid will correspond to the size and shape of the opening at the stopper step and is generally circular shaped. The lid may be made from a material such as card or cardboard, that is relatively stiffer than that of the cup (typically paper), which may also be coated/laminated with non plastic biodegradable material such as compostable and recyclable bio-resins-all referred to herein as "fibre", and the lids generally referred to herein as "fibre lids". The thickness of the fibre lid can vary depending on the application (for example, a thicker lid may be useful when it is to be used with hot/warm, greasy or wet products). Accordingly, the pleated portion cup may be provided with a fibre lid, thus protecting the contents of the portion cup from contamination or from spillage. The contents may be a food or non-food product, a perishable or non-perishable product, and may be in the form of a liquid, paste or solid. A particular contemplated use for the present pleated portion cup is for the containing and transporting a small portion of condiment (e.g. ketchup) and is generally discussed in that context; however, it should be understand that the present improved pleated portion cup may be used for containing other food and non-food products—anything that may benefit from being protected from contamination and/or spillage, or that otherwise requires a cover. In practice, it has been found that the pleated portion cup and fibre lid combination as presently contemplated cannot generally withstand temperatures above 130° F. (whether that be the temperature of the contents or ambient temperature) without the structure thereof starting to become weakened.

Figure 1:
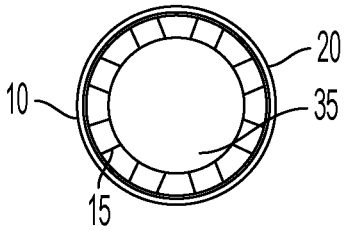
FIG. 1 is a top plan view of an embodiment of the portion cup in accordance with an aspect of the present invention.
Figure 2:
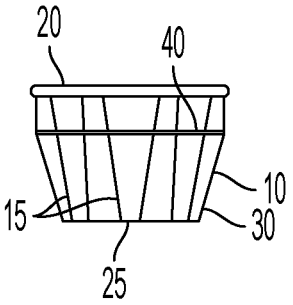
FIG. 2 is a side view of the portion cup.

Referring to FIG. 1, this shows a top plan view of an embodiment of the pleated portion cup 10. The pleated portion cup 10 is typically made from paper, or a paper-based or paper-like material, and may be made from a single circular-shaped blank. Preferably, the paper may be coated (on one or both sides) with wax (generally to increase the paper's resistance to food grease and water, etc.) or it may be made from non-plastic biodegradable material, such as compostable and recyclable bio-resins-all generally referred to herein as "paper"). The pleated portion cup 10 comprises a substantially circular base 25, side walls 30, and a top rim 20. The top rim 20 defines a substantially circular shaped opening for the pleated portion cup. The side walls 30 generally taper slightly outwards as they go up from the base 25, i.e. the diameter of the base 25 is slightly smaller than the diameter of the opening at the top rim. The pleated portion cup is formed by folding the blank into a cup shape. The disposition and arrangement of the pleated folds 15 help the cup to maintain its shape (as they help strengthen the side walls) without requiring the use of glue, and the portion cup presents no joints or seams. The pleated folds also provide a degree of flexibility to the portion cup in that the side walls provide some "give"; i.e. the side walls can be made to stretch out/expand slightly when a force is applied (the importance of which will be discussed later). The folded pleats generally extend from the bottom of the side walls (at the base) to the rim 20. The top rim 20 is generally crimped or rolled down to the provide a stiffer edge and to prevent the folded pleats 15 from coming "loose". Thus, the folded pleats and the rolled top rim help the pleated portion cup keep its shape, so that it does not easily open apart when in use and is sturdy enough to hold the condiment/contents. The base 25 and side walls 30 thus define an inside space 35 for containing a condiment or other product. FIG. 2 shows a corresponding side view of the pleated portion cup 10. As can be more clearly seen in FIG. 2, the portion cup is provided with a stopper step 40 along the side walls 30, which is disposed proximate to the top rim 20, but a short distance below. The stopper step 40 is adapted to receive and frictionally engage a corresponding circular-shaped fibre lid (not shown), thereby covering the contents and preventing it from being exposed to contaminants and also preventing spillage of the contents.

Figure 3:
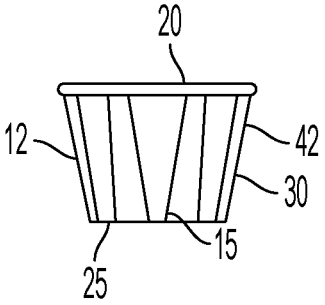
FIG. 3 is a side view of the portion cup, shown in an intermediate stage during the manufacturing process, prior to the stopper step forming stage.

The present pleated portion cup 10 is based on conventional "souffle cups" (which have been known for a considerable time), but represents an improvement thereof. In terms of the process for manufacturing the pleated portion cups, a conventional souffle cup represents an intermediate stage in the process of manufacturing the present pleated portion cups. In other words, it is contemplated that a conventional souffle cup may be further processed (by applying what is referred to herein as a stopper step forming stage) in order to form the final pleated portion cup 10. Referring to FIG. 3, this shows a precursor 12 of the pleated portion cup, which also happens to be the same as a conventional souffle cup. This precursor cup may be further processed by applying a suitable mandrel and mold arrangement (illustrated later), in order to form the pleated portion cup 10. In effect, the mandrel and mold arrangement operate to push and expand out a portion of the side walls at the step position 42 to form the stopper step 40. The pleated folds 15 of the precursor cup 12 are such that the side walls have some "give" and are expandable by application of some force. (The side walls present a series of symmetrically disposed box pleats, and the edge of the precursor cup 12 presents an annular down-turned shape, so that the folds of the pleats lock the shape, and the folded pleats can be "opened" by application of force).

The fact that the present pleated portion cup may be made from a conventional souffle cup is practically advantageous and significant, because it means that existing equipment for manufacturing conventional souffle cups may be relatively easily reconfigured/adapted (generally by the addition of an extra stopper step forming stage, described in more detail below) to manufacture the present pleated portion cups.

Figure 4:
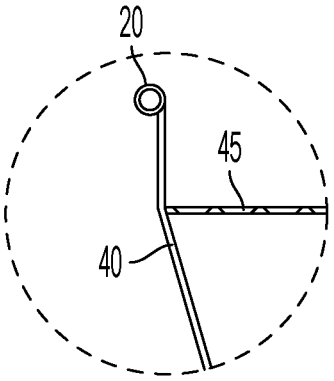
FIG. 4 is a magnified, cross-sectional view of a part of the portion cup, with a lid applied.

FIG. 4 is a magnified, cross-sectional view of a part of the pleated portion cup 10, with a fibre lid 45 affixed. The fibre lid is held in place by friction. In some embodiments the stopper step may also be provided with a groove to more securely engage with the lid (or to more clearly indicate to the user that the lid is properly engaged). As can be seen, the side walls 30 above the stopper step 40 are substantially vertical (i.e., this portion of the side walls does not flare out like side walls below the stopper step. Optionally, it is contemplated that the pleated portion cup may be provided with a "fill level" or "stop line", positioned at or below stopper step 40 or step position 42, which will indicate to the user the maximum amount of condiment or other product that the pleated portion cup can hold (without expanding the pleated folds).

Figure 5:
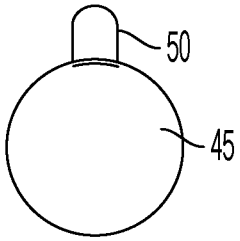
FIG. 5 is a top plan view of an exemplary lid for the portion cup.

FIG. 5 is a top plan view of an exemplary fibre lid 45 for the pleated portion cup. The fibre lid is sized to fit snugly in the opening of the pleated portion cup at the stopper step (and is generally substantially-circular shaped). As mentioned above, the fibre lid is generally constructed from a stiffer/stronger material than the paper of the pleated portion cup. This helps ensure a tight fit, because the pleated portion cup can expand slightly and adapt its diameter to the fibre lid. (The pleated portion cups are made from thin paper and the fibre lid may be made with thicker fibre cardboard). A user will, after filling the pleated portion cup with some condiment, simply place the lid on top of the pleated portion cup and push the lid down until it sits at the stopper step and apply moderate pressure until the lid feels tight. Once the lid is positioned at the stopper step, there will be less "give" in the side walls because at that point the side walls starts to taper down and the diameter gets smaller; it will thus be apparent to the user that the lid is properly positioned and engaged. As shown, the lid 45 may also be provided with a pull or tear tab 50 to facilitate subsequent removal of the lid 45 when desired.

In one of the main use cases for the present invention (i.e. for holding/transporting condiments and other food products in the fast-food industry), the containers with lids are intended for single use, after which they are disposed. Thus, it is particularly important that any proposed solution be of simple construction and very low cost. Further, it also important (and perhaps increasingly so), that any proposed solution be compostable and recyclable. The present pleated portion cup delivers on all these fronts. Firstly, the pleated portion cup can be made simply from paper (just like conventional souffle cup that is widely used in the fast-food industry). The paper portion cup and fibre lids are highly compostable and recyclable. The construction of the pleated portion cups is simple and straightforward, and may be formed by folding and molding a circular paper blank, relying primarily on folded pleats to provide its structure/strength; no use of adhesives or jointing is required.

The invention disclosed herein provides a number of significant advantages over, for example, the use of cups with plastic lids (which are perhaps the closest alternatives to the present invention). For example, the pleated portion cup is generally much more easily compostable and the recyclable, as the material is all fibre/paper instead of plastic. Also, the overall cost is much lower than plastic containers/lids. Furthermore, the use of the fibre lid is more user friendly, as it is very easy to put in place over the portion cup, requiring comparatively very little coordination and requiring very little force to be applied to engage (as compared with plastic snap-on lids). In addition, the presence of the stopper step makes filling the portion cup close to the maximum level easy to do. Manufacturing molds to produce plastic lids is expensive, meaning that it will not be so easy to adjust or modify the dimensions of lids; in contrast, a fibre/cardboard lid is easy to change.

The process by which the pleated portion cup may be manufactured is also outlined below. As mentioned above, this process, up to the stage where the precursor cup 12 is manufactured, is essentially identical to existing processes for manufacturing conventional souffle cups. This typically involves punching out or cutting out a paper blank using a knife. The circular blank is then passed to a creaser, where the folded pleats are folded (generally achieved by applying pressure created by cam motion). After the creaser step, the blank is formed into the side walls of the pleated portion cup using a die arrangement. Following this, the top rim is formed at a spindle station, and precursor cup 12 is completed. The foregoing steps are performed at the different stations on a dial plate 120, with the intermediate work product being transferred from one station to next, as the various steps are performed on the work product to create the precursor cup. Once done, the remaining step is to transform the precursor cup 12 into the final form of the pleated portion cup 10. This occurs at the stopper step forming stage. The precursor cup is transferred from a dial plate 120 with the help of a dial plate transfer platform 65 (see FIG. 6) to the apparatus of the stopper step forming stage.

Figure 6:
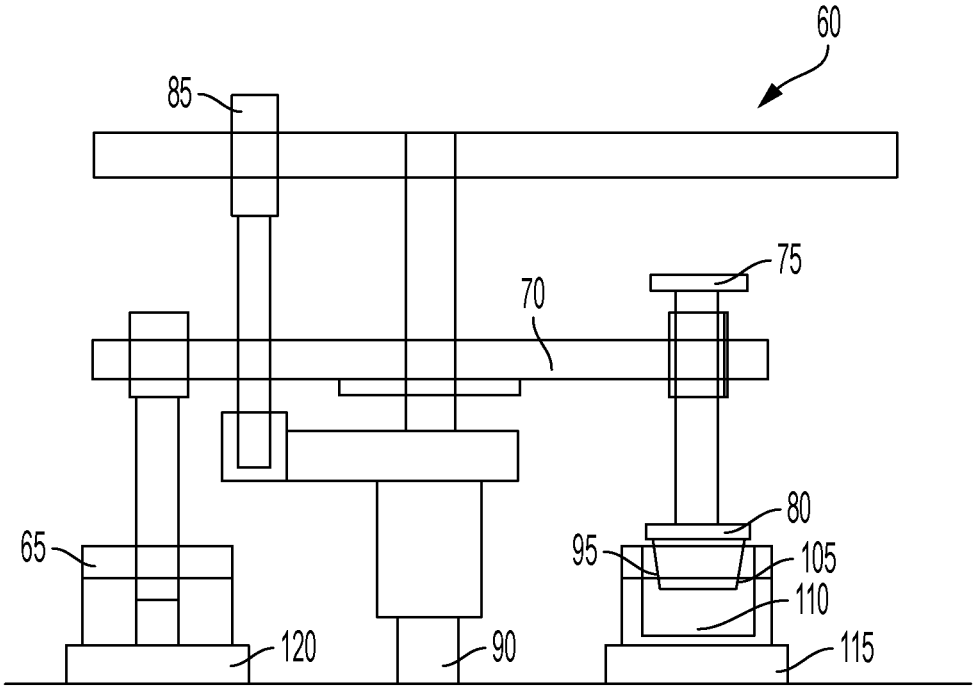
FIG. 6 is a schematic side view illustrating the configuration of an exemplary apparatus used for the stopper step forming stage.

FIG. 6 is a diagrammatic side view illustrating the configuration of an exemplary apparatus (sometimes referred to herein as a "step assembly" 60) used for the stopper step forming stage. The forming device 80 is the main mechanism to imprint the final form to the pleated portion cup 10. The precursor cup 12 enters the assembly at the dial plate transfer platform 65. A precursor cup is passed to the forming device 80 (the components rotate about central shaft 90). The sput holder 70 (which rotates about the central shaft 90) is the main part attaching to the pusher shaft 75. At the bottom of the pusher shaft 75 is a pickoff mandrel 95 (which has a shape/size generally corresponding to that of the final pleated portion cup). Below the pickoff mandrel 95 is a cup mold 105 which is held in position by a stopper step former base 115. The cup mold 105 is configured to matingly receive the pickoff mandrel 95. The pickoff mandrel 95 and the cup mold 105 cooperate together to "sandwich" the precursor cup therebetween in order to expand and push out the portion of the side walls 30 of the precursor cup above the step position, thereby forming the stopper step for the pleated portion cup. The finished pleated portion cup is then pushed out from the cup mold by the ejector 110 for further processing/packaging. Locating pin 85 functions to maintain accuracy of alignment.

Figure 7:
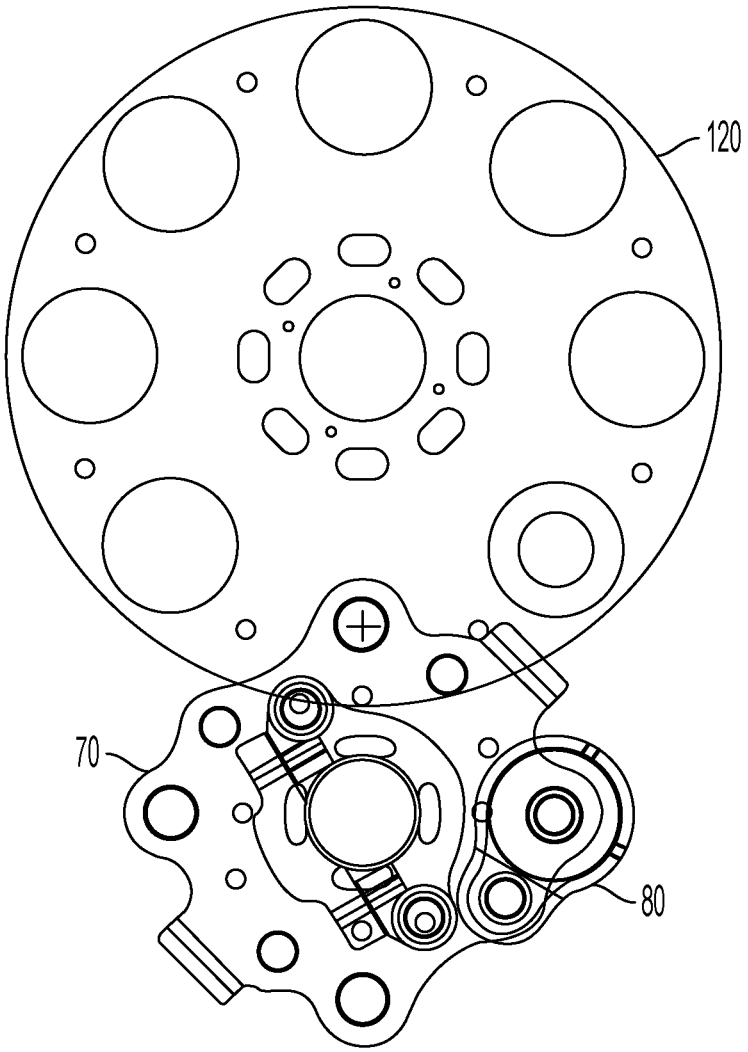
FIG. 7 is a top plan view of the dial plate and the apparatus used for the stopper step forming stage.

FIG. 7 is a top plan view of a dial plate 120 and the apparatus used for the stopper step forming stage (step assembly 60). The various processing steps described above that are taken to arrive at the precursor cup 12 are performed on the dial plate. The precursor cup is then transferred to the dial plate transfer platform 65 of the apparatus used for the stopper step forming stage.

Figure 8:
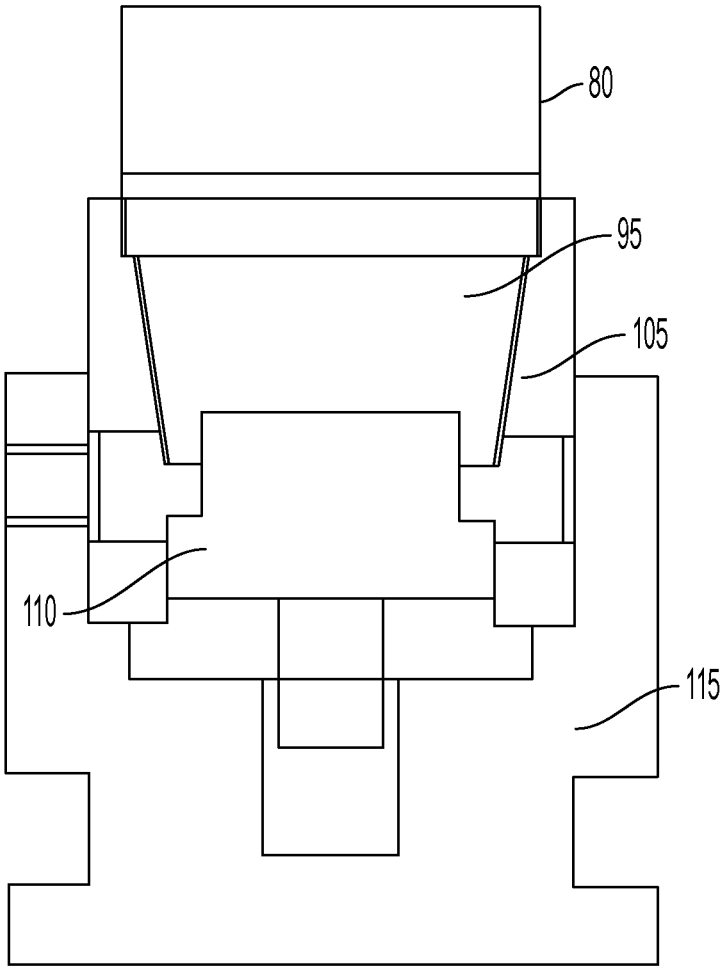
FIG. 8 is another diagrammatic side view illustrating the forming device used for the stopper step forming stage.
Figure 9:
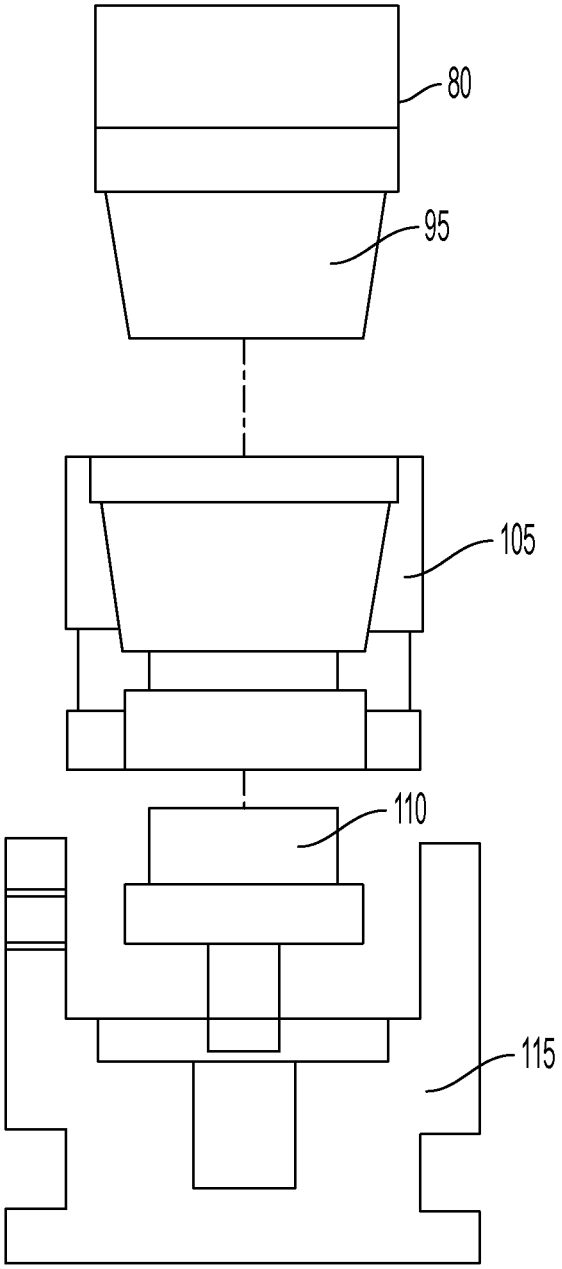
FIG. 9 is an exploded view of the component parts of the forming device.

FIG. 8 is a more detailed diagrammatic side view illustrating the forming device 80. FIG. 9 is an exploded view of the component parts of the forming device.

It is also contemplated that the step assembly 60, being of relatively compact design, may be conveniently and relatively easily added to an existing machine used to manufacture conventional souffle cups, in order to reconfigure such to manufacture the improved pleated portion cups.

It is to be understood that embodiments of the invention disclosed are not limited to the structures, process steps, or materials disclosed herein, but are extended to equivalents thereof as would be recognised by those ordinarily skilled in the relevant arts. It should also be understood that terminology employed herein is used for the purpose of describing embodiments only and is not to be limited.

The described features, structures, or characteristics may be combined in any suitable manner in one or more embodiments. One skilled in the relevant art will recognize, however, that the invention can be practiced without one or, more of the specific details, or with other methods, components, materials, etc. In other instances, well-known structures, materials, or operations are not shown or described in detail to avoid obscuring aspects of the invention. While specific embodiments have been described and illustrated, such embodiments should be considered illustrative of the invention only and not as limiting the invention as construed in accordance with the accompanying claims.

The invention claimed is:

1. A disposable container for holding a food product, comprising:

a substantially circular-shaped base;

substantially annular side walls, the side walls having a lower ring and an upper ring, the lower ring connected to and extending around a periphery of the base, and the upper ring forming a substantially circular-shaped rim and defining an opening, and the side walls having a plurality of pleated folds extending from the base to the rim to strengthen the side walls; and a stopper step, disposed around a periphery of the side walls proximate to and below the rim, wherein the stopper step is configured to, on an inside surface of the stopper step, receive and frictionally engage an outside peripheral edge of a substantially circular-shaped fibre lid in a covered position, thereby closing the opening, and wherein, when the fibre lid is placed in the covered position, the base, the side walls and the fibre lid together define an enclosed inside space for containing the food product.

2. The container of claim 1, wherein the container is made from paper.

3. The container of claim 2, wherein the base, the rim, the stopper step and the side walls are unitary and formed from a single paper blank.

4. The container of claim 1, further comprising a substantially circular-shaped fibre lid, wherein an outside peripheral edge of the fibre lid is sized such that the outside peripheral edge frictionally engages with the inside surface of the stopper step at a covered position, thereby closing the opening and covering the food product.

5. The container of claim 4, wherein the fibre lid is made of card or carboard.

6. The container of claim 4, wherein the fibre lid is provided with a tear tab to facilitate subsequent removal of the fibre lid.

7. The container of claim 4, wherein the container and fibre lid are made from compostable materials.

8. The container of claim 2, wherein the paper is provided with a coating of wax, a bio-resin or a non-plastic biodegradable material to improve the container's resistance to oils, grease and/or moisture.

9. The container of claim 5, wherein the fibre lid is provided with a coating of wax, a bio-resin or a non-plastic biodegradable material to improve its resistance to oils, grease and/or moisture.

10. The container of claim 1, wherein the side walls extend upwardly and outwardly from the base, such that the diameter of the upper ring is greater than the diameter of the lower ring.

11. The container of claim 1, wherein the food product is a condiment.

* * * * *